US011761643B2

(12) United States Patent
Gedcke et al.

(10) Patent No.: US 11,761,643 B2
(45) Date of Patent: Sep. 19, 2023

(54) CONDENSATE COLLECTING BASE MEMBER FOR A HEATING AND COOLING UNIT

(71) Applicant: Allied Air Enterprises LLC, West Columbia, SC (US)

(72) Inventors: Jeffery Paul Gedcke, Gilbert, SC (US); Joseph Ephraim Whisenhunt, Lugolff, SC (US); Colin Mullins, West Columbia, SC (US); Randy Brian Palm, Barnwell, SC (US); Joseph Nathaniel Faulk, Lexington, SC (US)

(73) Assignee: Allied Air Enterprises LLC, West Columbia, SC (US)

( * ) Notice: Subject to any disclaimer, the term of this patent is extended or adjusted under 35 U.S.C. 154(b) by 283 days.

(21) Appl. No.: 17/113,340

(22) Filed: Dec. 7, 2020

(65) Prior Publication Data

US 2021/0140653 A1 May 13, 2021

Related U.S. Application Data

(63) Continuation of application No. 15/000,356, filed on Jan. 19, 2016, now abandoned.

(Continued)

(51) Int. Cl.

*F24F 13/22* (2006.01)
*F24F 1/029* (2019.01)

(Continued)

(52) U.S. Cl.

CPC ..... *F24F 1/029* (2019.02); *F24F 1/031* (2019.02); *F24F 1/0323* (2019.02); *F24F 13/20* (2013.01);

(Continued)

(58) Field of Classification Search

CPC ..... F24F 1/029; F24F 1/02; F24F 1/36; F24F 1/031; F24F 1/0323; F24F 13/20;

(Continued)

(56) References Cited

U.S. PATENT DOCUMENTS 2,472,792 A 6/1949 Cohler
2,970,457 A * 2/1961 Earle ..... F24F 1/029 62/262

(Continued)

*Primary Examiner* — Travis Ruby
(74) *Attorney, Agent, or Firm* — Bradley Arant Boult Cummings

(57) ABSTRACT

A base member includes a substantially horizontal main body that supports one or more components of a heating and cooling unit. The main body includes a conditioned space portion about a first side of the main body and a non-conditional space portion about a second side of the main body. A substantially vertical separation wall extends up from the main body and separates the conditioned space portion from the non-conditioned space portion. A lip is formed at least partially about the non-conditioned space portion. At least one drainage hole extends through the non-conditioned space portion. A surface of the non-conditioned space portion is sloped towards the at least one drainage hole. A drain pan is disposed about the conditioned space portion. At least one drainage tube is in fluid communication with the drain pan. A surface of the drain pan is sloped towards the at least one drainage tube.

13 Claims, 20 Drawing Sheets

Related U.S. Application Data

(60) Provisional application No. 62/105,258, filed on Jan. 20, 2015.

(51) Int. Cl.

| | |
|---|---|
| ***F24H 9/06*** | (2006.01) |
| ***F24H 9/02*** | (2006.01) |
| ***F24H 9/14*** | (2006.01) |
| ***F24F 13/20*** | (2006.01) |
| ***F24F 1/0323*** | (2019.01) |
| ***F24F 1/031*** | (2019.01) |

(52) U.S. Cl.
CPC ..... *F24H 9/02* (2013.01); *F24H 9/06* (2013.01); *F24H 9/148* (2013.01); *F24F 13/22* (2013.01)

(58) Field of Classification Search
CPC .. F24F 13/22; F24F 13/32; F24F 13/30; F24F 13/224; F24F 2013/227; F24F 2221/36; F24H 9/02; F24H 9/06; F24H 9/148; F24H 9/16; F24H 8/006; F28F 2225/02; F28F 17/005
See application file for complete search history.

(56) References Cited

U.S. PATENT DOCUMENTS 3,486,523 A * 12/1969 Mullings ..... F24D 5/00 137/271
3,724,233 A * 4/1973 Pugh ..... F25D 21/14 62/262
3,741,290 A * 6/1973 Nenadal ..... F24F 13/20 62/262
3,783,637 A 1/1974 Woods
3,977,467 A * 8/1976 Northrup, Jr. ..... F24H 3/0405 165/137
5,379,749 A * 1/1995 Rieke ..... F24H 8/006 137/247.27
5,715,697 A 2/1998 Rust, Jr. et al.
5,749,355 A * 5/1998 Roan ..... F24H 8/00 126/110 R
6,151,906 A * 11/2000 da Silva ..... F24F 1/027 62/279
6,155,065 A 12/2000 da Silva
6,289,688 B1 * 9/2001 da Luz Moraes ..... F24F 1/027 62/298
6,298,678 B1 * 10/2001 Kim ..... F24F 1/027 62/262
6,321,553 B1 11/2001 Bushnell et al.
6,895,770 B1 5/2005 Kaminski
7,263,850 B2 * 9/2007 Eom ..... F24F 1/005 62/286
8,056,553 B2 * 11/2011 Khan ..... F24H 3/087 126/110 R
8,211,198 B2 * 7/2012 Weber ..... F24F 13/28 55/484
2003/0029183 A1 * 2/2003 Ohama ..... F24F 1/027 62/262
2003/0094010 A1 5/2003 Katatani et al.
2004/0094289 A1 * 5/2004 Harshberger ..... F24F 13/20 62/262
2004/0168461 A1 * 9/2004 Park ..... F24F 1/027 62/262
2005/0132737 A1 * 6/2005 Jeon ..... F24F 1/005 62/286
2008/0104988 A1 * 5/2008 Lee ..... F24F 13/222 62/285
2010/0037574 A1 2/2010 Weber et al.
2012/0048257 A1 * 3/2012 Reifel ..... F24H 3/087 126/112
2014/0034038 A1 * 2/2014 Sherrow ..... F24H 8/006 126/114
2014/0202191 A1 7/2014 Jinnai et al.
2015/0300680 A1 10/2015 Kroetsch et al.

* cited by examiner

CONDENSATE COLLECTING BASE MEMBER FOR A HEATING AND COOLING UNIT

CROSS-REFERENCE TO RELATED APPLICATIONS

This application is a continuation of U.S. patent application Ser. No. 15/000,356, filed Jan. 19, 2016. U.S. patent application Ser. No. 15/000,356 claims priority to, and incorporates by reference for any purpose the entire disclosure of U.S. Provisional Patent Application No. 62/105,258, filed Jan. 20, 2015. U.S. patent application Ser. No. 15/000,356 and U.S. Provisional Patent Application No. 62/105,258 are incorporated herein by reference.

FIELD OF THE DISCLOSURE

The disclosure generally relates to heating, ventilating, and air conditioning units and/or components thereof.

BACKGROUND

Heating and cooling units combine heating and cooling applications for apartments, condominiums, and/or other types of multiple occupancy buildings. In some instances, due to space constraints, particularly in older buildings, certain heating and cooling units may not be suitable. Similarly, in newer building, architectural constraints may limit the amount of space available for heating and cooling units. Accordingly, there is a need for an efficient and compact heating and cooling unit that is capable of meeting the heating and cooling requirements in a variety of applications and settings.

SUMMARY

According to an embodiment, a heating and cooling unit (as well as individual components of the heating and cooling unit) is disclosed herein. Methods of installing and using the heating and cooling unit are also disclosed herein. The heating and cooling unit may include, among other things, a base member, a tube chase, a convertible drain, a system for mounting a burner box in a sideways orientation to a vestibule panel, a system for removably attaching a control panel to a collector box, a compressor supply plug, or a combination thereof.

Other features and aspects of the heating and cooling unit will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
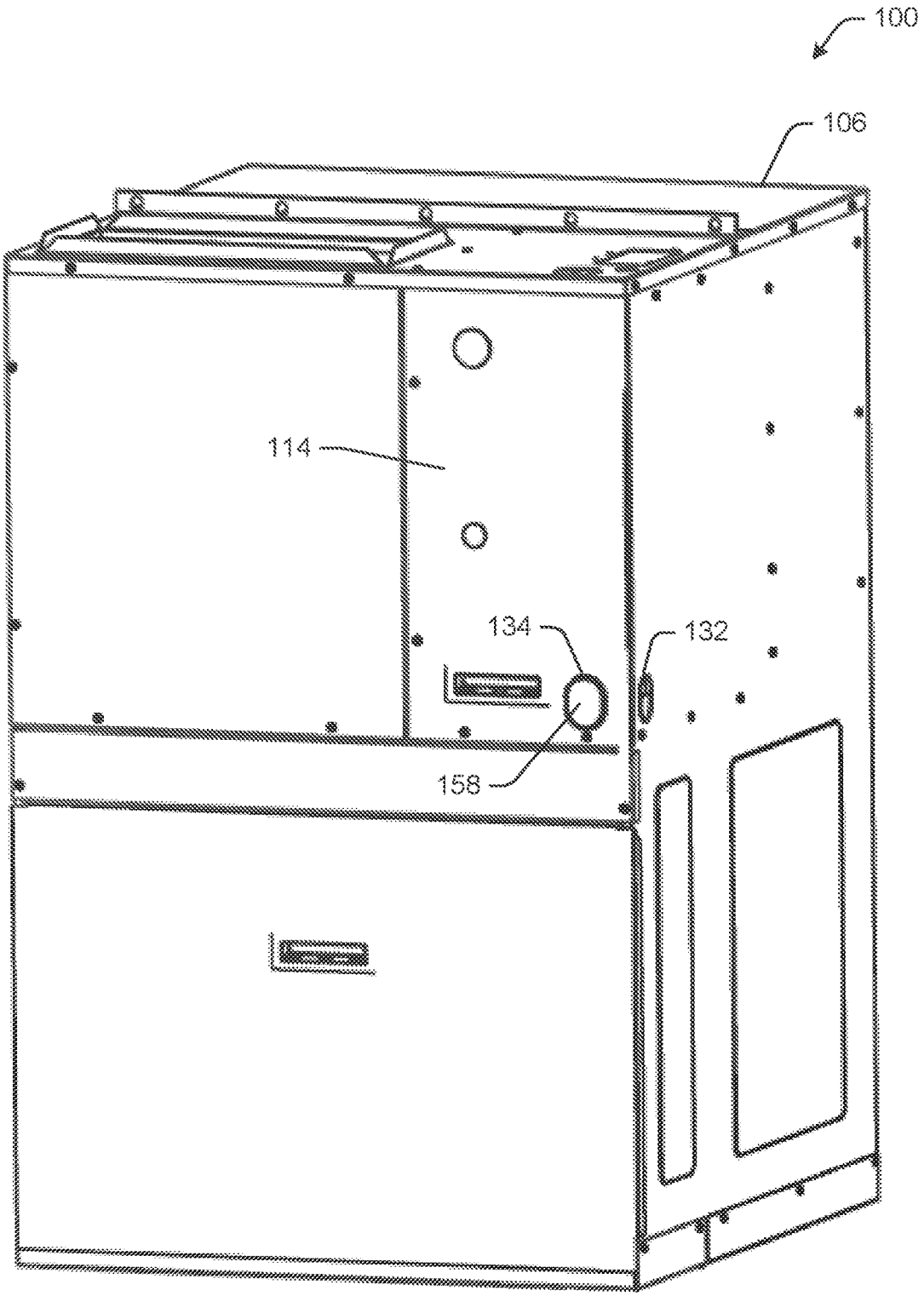
FIG. 1 schematically depicts an example heating and cooling unit in accordance with one or more embodiments of the disclosure.

Described below are embodiments of a heating and cooling unit 100 (as well as individual components of the heating and cooling unit 100). Methods of installing and using the heating and cooling unit 100 are also disclosed. FIG. 1 generally depicts the heating and cooling unit 100 as a whole. In certain embodiments, the heating and cooling unit 100 may be a single package vertical (SPV) heating and cooling unit. The heating and cooling unit 100 may be any type of heating and cooling unit. The heating and cooling unit 100, or aspects thereof, may be used in residential or commercial settings. For example, the heating and cooling unit 100 may be used to heat and/or cool an interior space, such as a room, an apartment, a house, a building, etc. In some instances, the heating and cooling unit 100 may be installed into an opening that is made into an outside wall. Additionally, the heating and cooling unit 100 may be installed adjacent to an outside wall with a wall sleeve connecting the unit to the outdoors. That is, a portion of the heating and cooling unit 100 may be in communication with the interior space, while another portion of the heating and cooling unit 100 may be in communication with the surrounding ambient environment. For example, the heating and cooling unit 100 may be located about an exterior wall, with part of the heating and cooling unit 100 positioned within the interior space and part of the heating and cooling unit 100 positioned outside.

Figure 2:
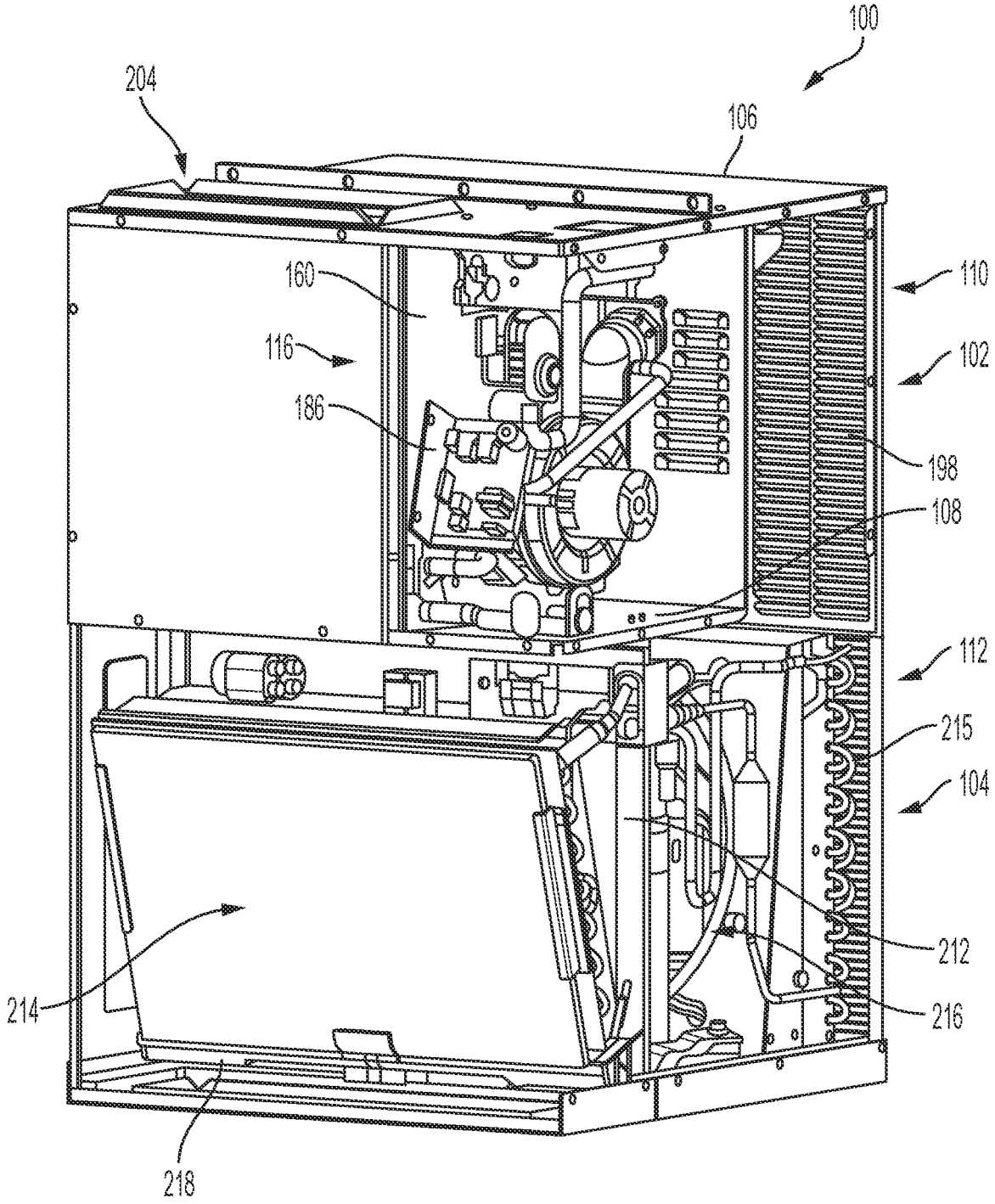
FIG. 2 schematically depicts a partial view of an example heating and cooling unit in accordance with one or more embodiments of the disclosure.

As depicted in FIG. 2, the heating and cooling unit 100 may include a heating system 102 and a cooling system 104. The heating system 102 may be generally disposed above the cooling system 104 or vice versa. In some instances, the heating system 102 may include a condensing heat exchanger. Any type of heating system may be used herein. The cooling system 104 may include a refrigeration cycle air conditioner or the like. Any type of cooling system may be used herein. Likewise, any type of heating or refrigeration circuit may be used herein.

The heating and cooling unit 100 may include an exterior casing 106. The exterior casing 106 may be a single panel or a number of panels formed together. A horizontal division panel 108 may be disposed within the casing 106. The division panel 108 generally may separate a heating system compartment 110 from a cooling system compartment 112. The exterior casing 106 of the heating system compartment 110 may include a removable front panel 114 (as depicted in FIG. 1) for accessing one or more components of the heating and cooling unit 100. For example, the removable front panel 114 may provide access to a combustion compartment 116. The exterior casing 106 and the panels thereof may be made out of sheet metal and similar types of substantially rigid substrates.

Figure 3:
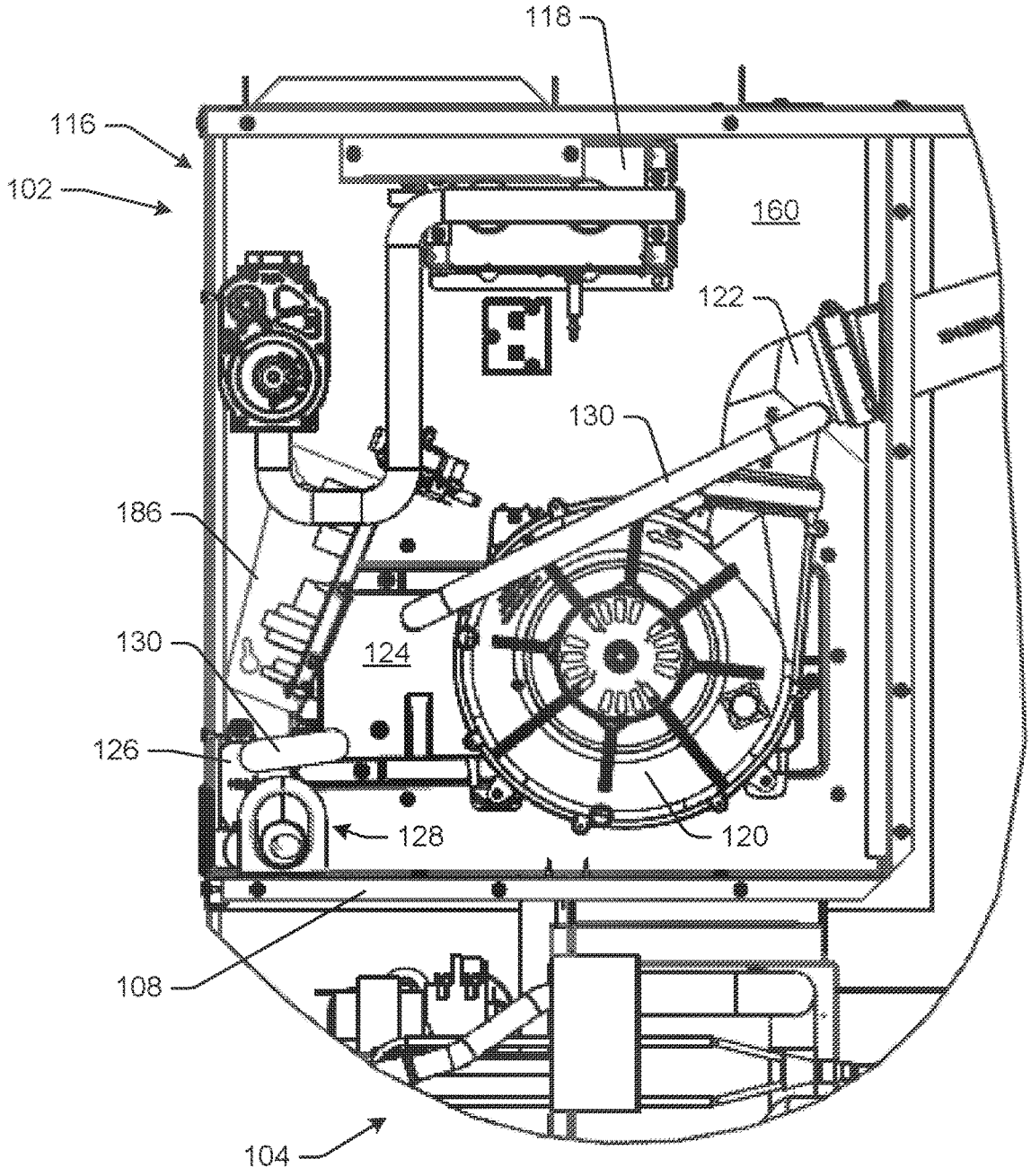
FIG. 3 schematically depicts a partial view of an example heating and cooling unit in accordance with one or more embodiments of the disclosure.
Figure 4:
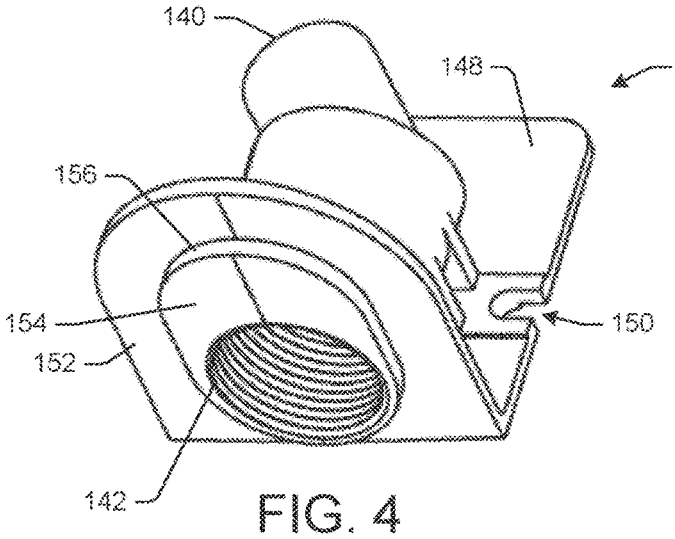
FIG. 4 schematically depicts an example drain adapter in accordance with one or more embodiments of the disclosure.
Figure 5:
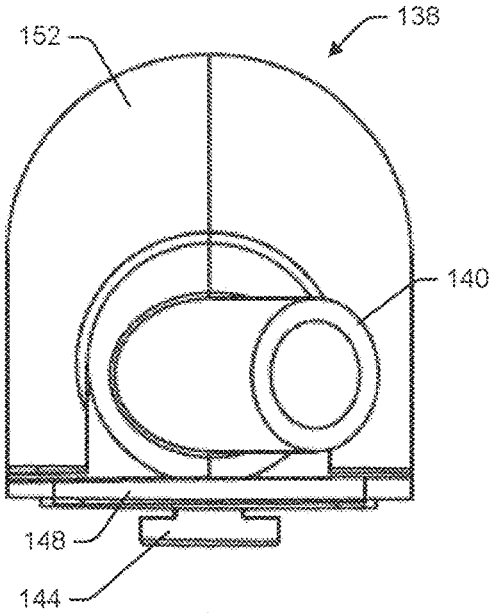
FIG. 5 schematically depicts a back view of an example drain adapter in accordance with one or more embodiments of the disclosure.
Figure 6:
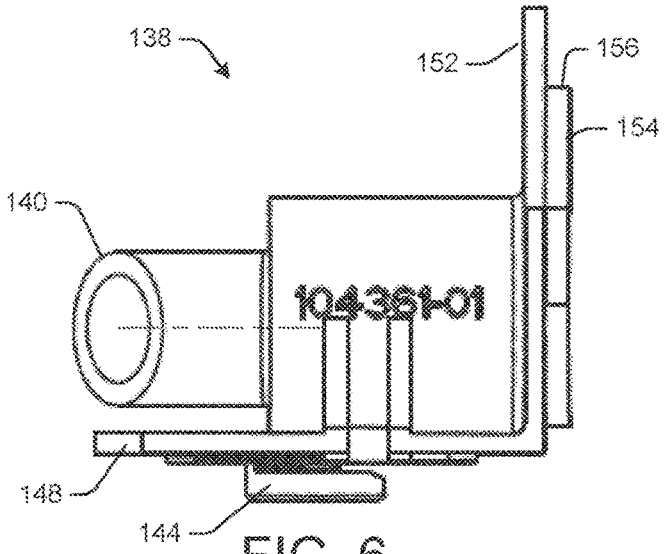
FIG. 6 schematically depicts a side view of an example drain adapter in accordance with one or more embodiments of the disclosure.

As depicted in FIG. 3, the combustion compartment 116 may include, among other things, a burner box 118, an inducer blower 120, and an exhaust flue 122. Other components of the heating system 102 may be disposed within the combustion compartment 116. The combustion compartment 116 also may include a drainage system including a collector box (cold side) 124, a trap 126, and a convertible drain 128. One or more drainage tubes 130 may connect the exhaust flue 122 with the collector box 124, the collector box 124 with the trap 126, and the trap 126 with the convertible drain 128. As depicted in FIG. 1, the convertible drain 128 may be in communication with an opening 132 in a side of the exterior casing 106 or in communication with an opening 134 in the removable front panel 114 depending on the arrangement of the convertible drain 128 and external space limitations.

For example, as depicted in FIGS. 4-9, the convertible drain 128 may include a hose 136. In some instances, the hose 136 may be flexible. In other instances, the hose 136 may include a fixed bend along its length. The convertible drain 128 also may include a drain adapter 138 having a first end with an inlet 140 (which the hose 136 is attachable to) and a second end with an outlet 142. In some instances, the inlet 140 may be angled relative to the outlet 142.

Figure 7:
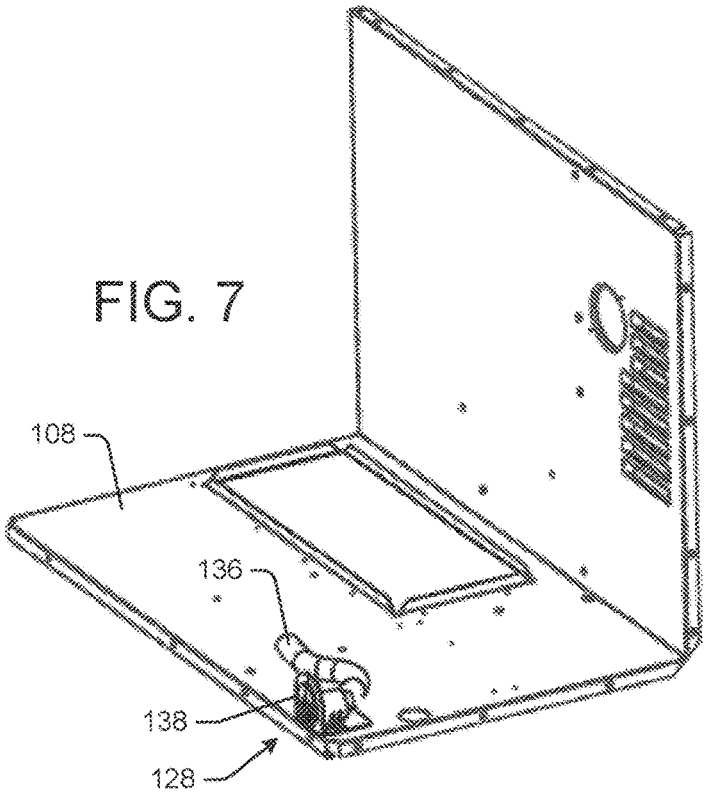
FIG. 7 schematically depicts an example drainage system in accordance with one or more embodiments of the disclosure.
Figure 8:
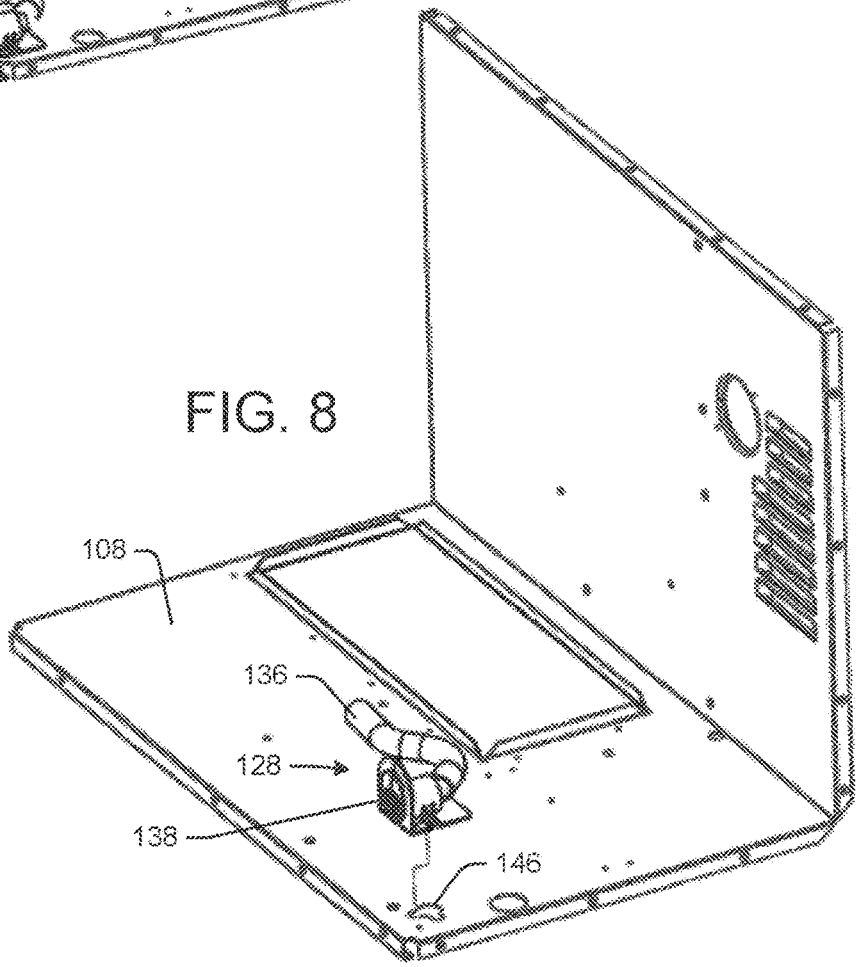
FIG. 8 schematically depicts an example drainage system in accordance with one or more embodiments of the disclosure.
Figure 9:
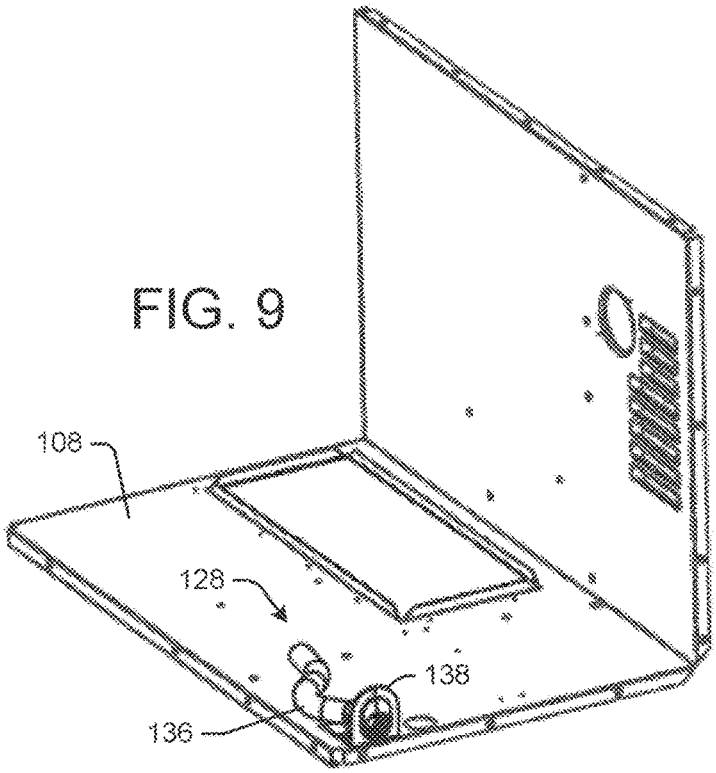
FIG. 9 schematically depicts an example drainage system in accordance with one or more embodiments of the disclosure.

The drain adapter 138 also may include an attachment bracket 144. A corresponding key hole 146 may be disposed in the division panel 108. The key hole 146 may include two configurations. In some instances, the key hole 146 may resemble the outline of Mickey Mouse's head, i.e. a main circle with two semi-circles or mouse ears extending therefrom. In this manner, as depicted in FIG. 9, the attachment bracket 144 may be configured to mate with the key hole 146 to secure the drain adapter 138 against the division panel 108 in a first configuration with the outlet 142 facing a side of the heating and cooling unit 100. In some instances, however, a clearance on the side of the heating and cooling 100 may not allow for drainage thereabout. In such instances, as depicted in FIG. 7, the attachment bracket 144 may be configured to mate with the key hole 146 to secure the drain adapter 138 against the division panel 108 in a second configuration with the outlet 142 facing a front of the heating and cooling unit 100. In some instances, the hose 136 may be rotated to accommodate the second positioned from the first portion and vice versa. Other configurations may be used herein.

The drain adapter 138 may include a bottom platform 148 having an attachment hole 150 therethrough. The attachment hole 150 may be used to attach the platform 148 to the division panel 108 by way of a fastener, such as a screw, a bolt, or the like, after the attachment bracket 144 is positioned within the key hole 146. The attachment bracket 144 may extend down from the bottom platform 148.

The drain adapter 138 also may include a flange 152 extending upward from the bottom platform 148. The flange 152 may be disposed about the outlet 142. The flange 152 may be configured to form a seal about the opening 132 in the side panel of the heating and cooling unit 100 when in the first configuration. Similarly, the flange 152 may be configured to form a seal about the opening 134 in the removable front panel 114 when in the second configuration.

A front surface 154 of the drain adapter 138 may extend out from the flange 152 to form a lip 156 therebetween. The front surface 154 may be configured to mate with the opening 132 in the side panel when in the first configuration or mate with the opening 134 in the removable front panel 114 when in the second configuration. In some instances, there may be a slight clearance between the opening 134 in the removable front panel 114 and the lip 156 in order to facilitate the removal of the removable front panel 114. As depicted in FIG. 1, a removable cover 158 may be used to cover the unoccupied opening 132 in the side panel or the unoccupied opening 134 in the removable front panel 114 depending on the orientation of the drain adapter 138. Other components and other configurations may be used herein.

Figure 10:
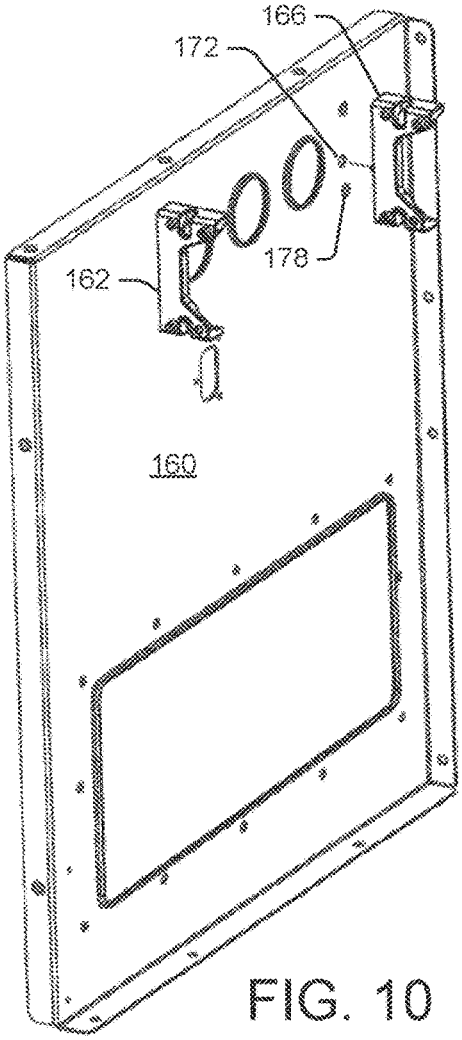
FIG. 10 schematically depicts an example burner box mounting system in accordance with one or more embodiments of the disclosure.
Figure 11:
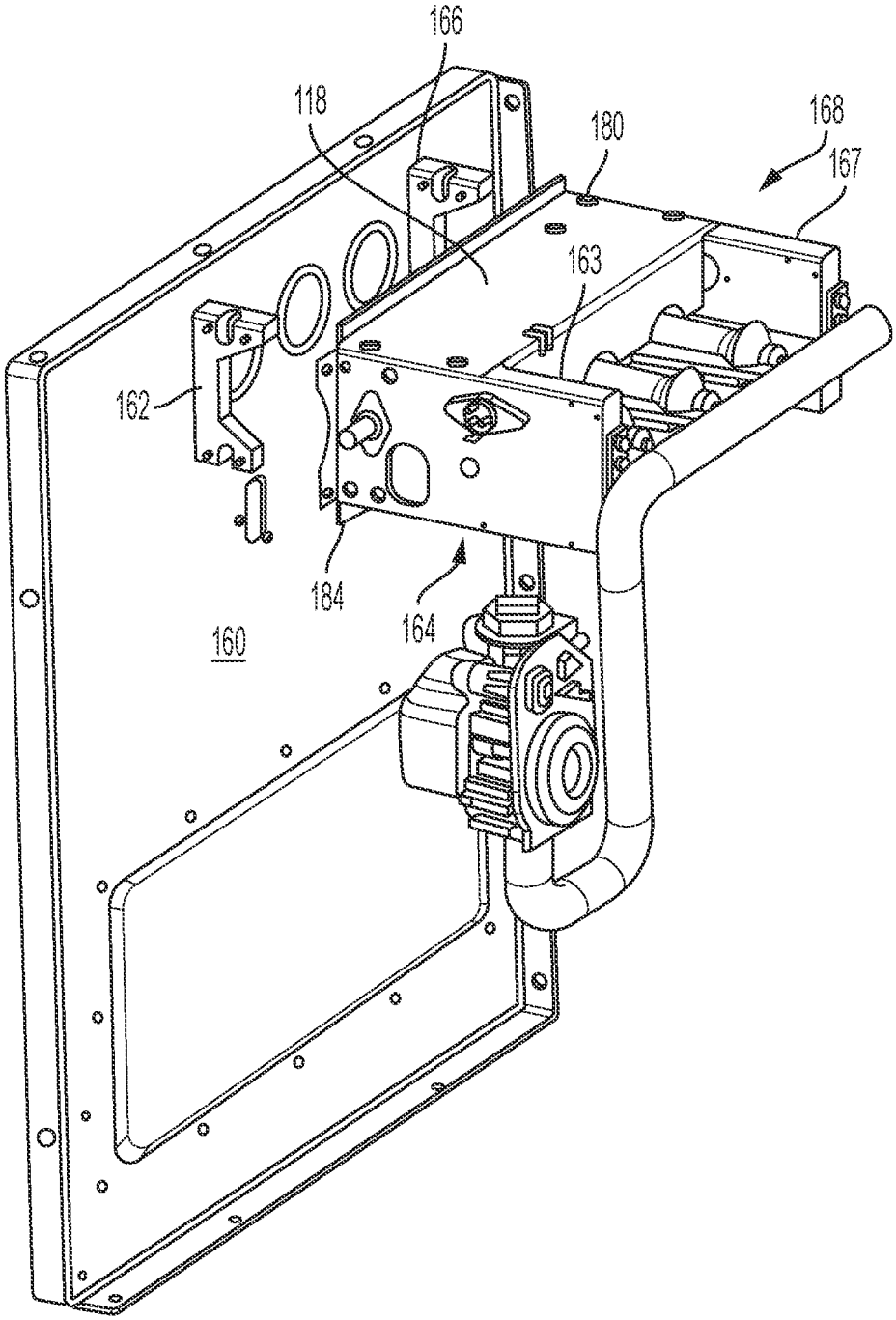
FIG. 11 schematically depicts an example burner box mounting system in accordance with one or more embodiments of the disclosure.
Figure 12:
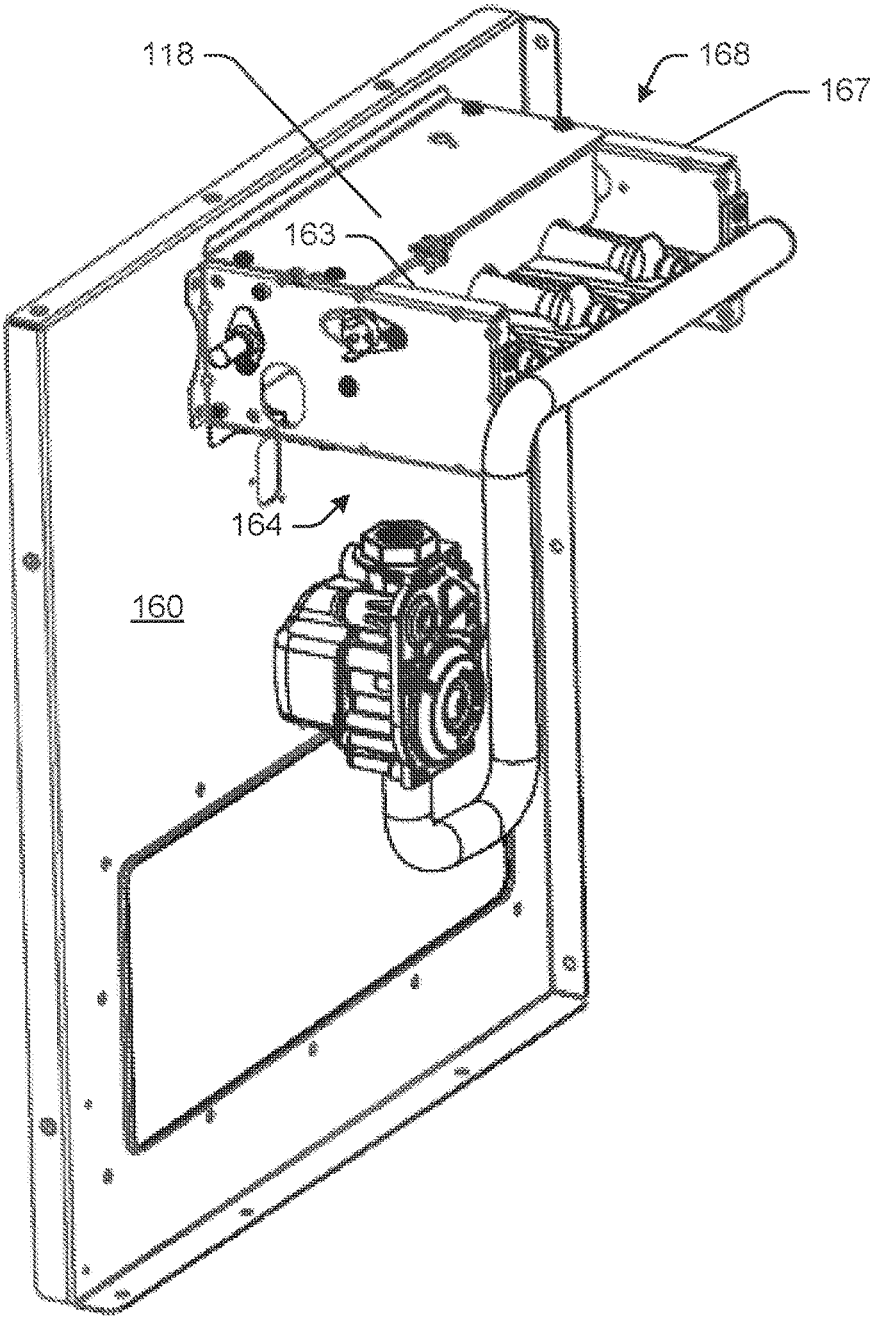
FIG. 12 schematically depicts an example burner box mounting system in accordance with one or more embodiments of the disclosure.
Figure 13:
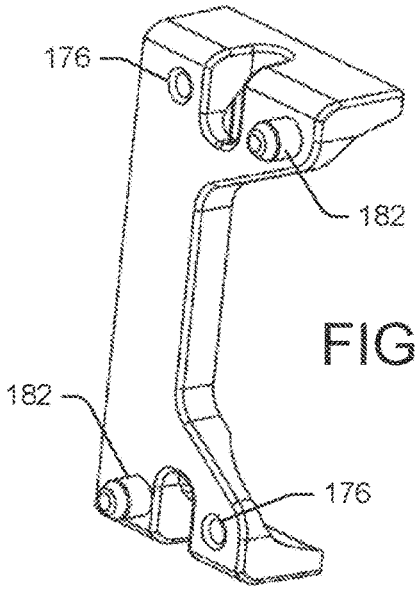
FIG. 13 schematically depicts an example mounting bracket in accordance with one or more embodiments of the disclosure.
Figure 14:
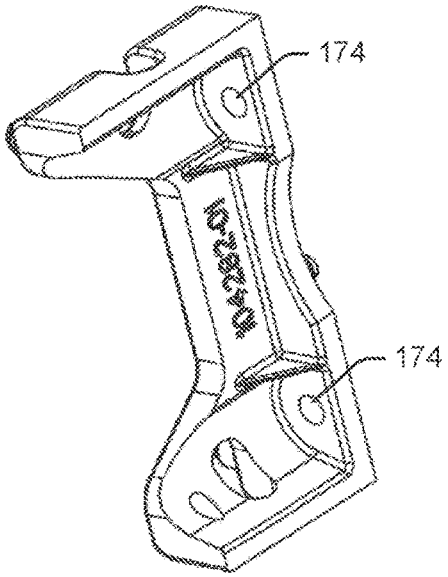
FIG. 14 schematically depicts an example mounting bracket in accordance with one or more embodiments of the disclosure.
Figure 15:
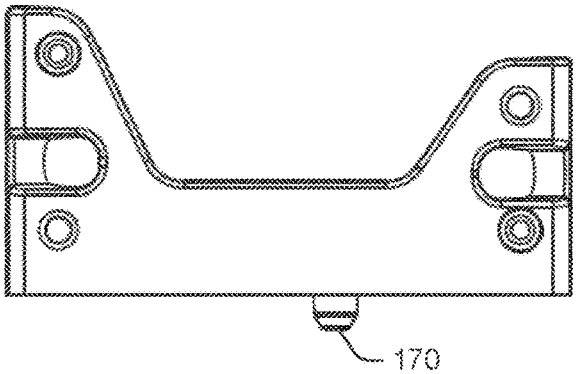
FIG. 15 schematically depicts a side view of an example mounting bracket in accordance with one or more embodiments of the disclosure.
Figure 16:
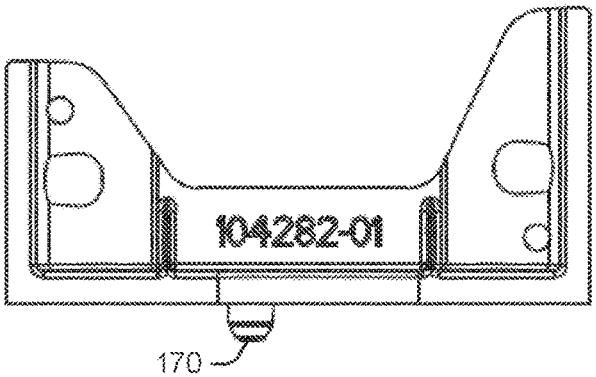
FIG. 16 schematically depicts a side view of an example mounting bracket in accordance with one or more embodiments of the disclosure.
Figure 17:
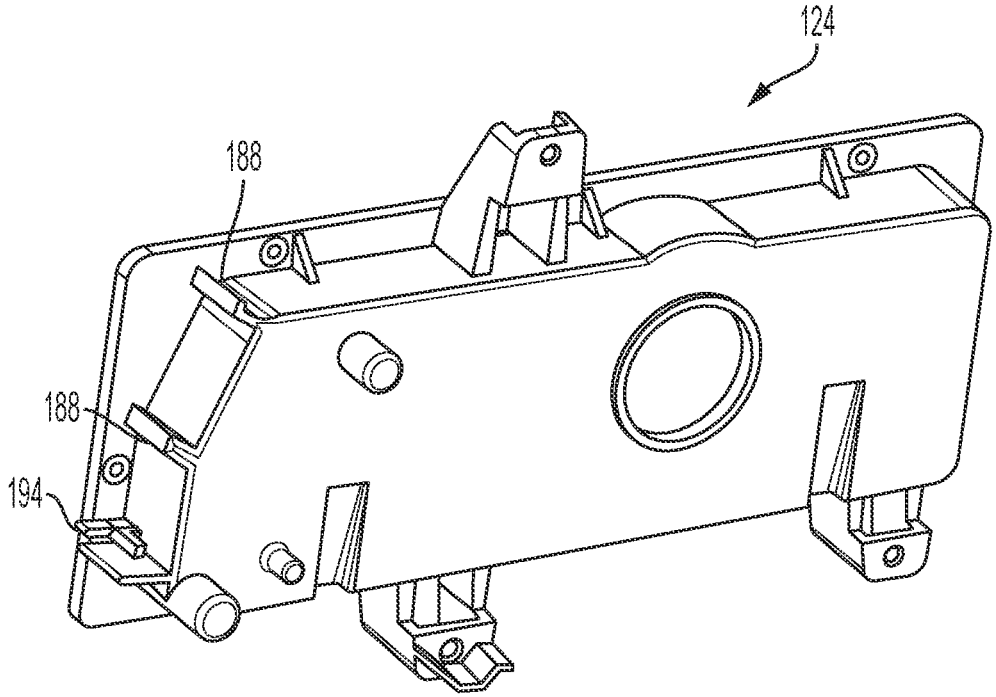
FIG. 17 schematically depicts an example collector box in accordance with one or more embodiments of the disclosure.
Figure 18:
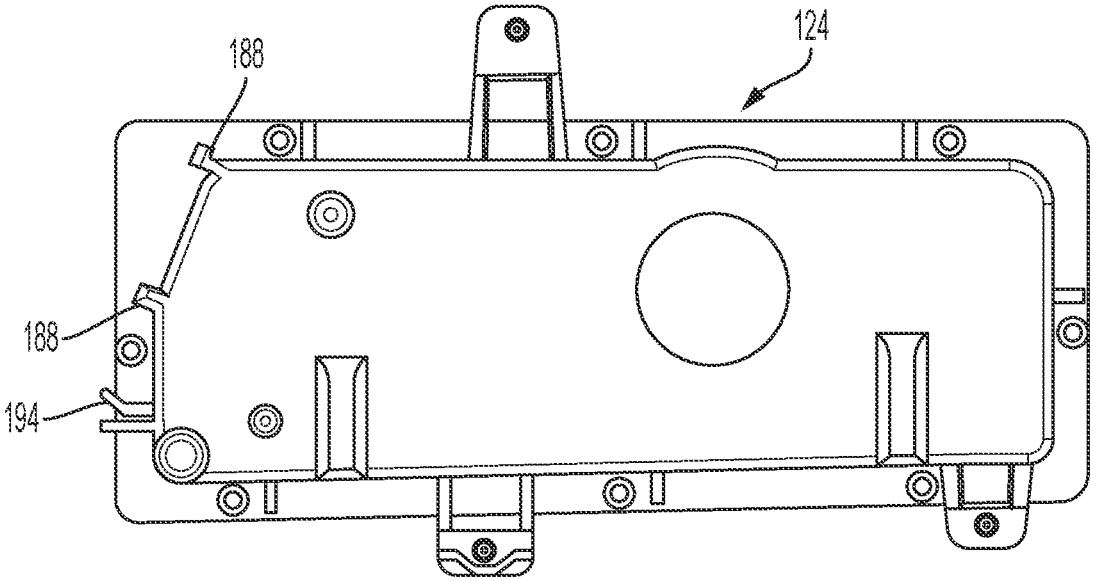
FIG. 18 schematically depicts an example collector box in accordance with one or more embodiments of the disclosure.
Figure 19:
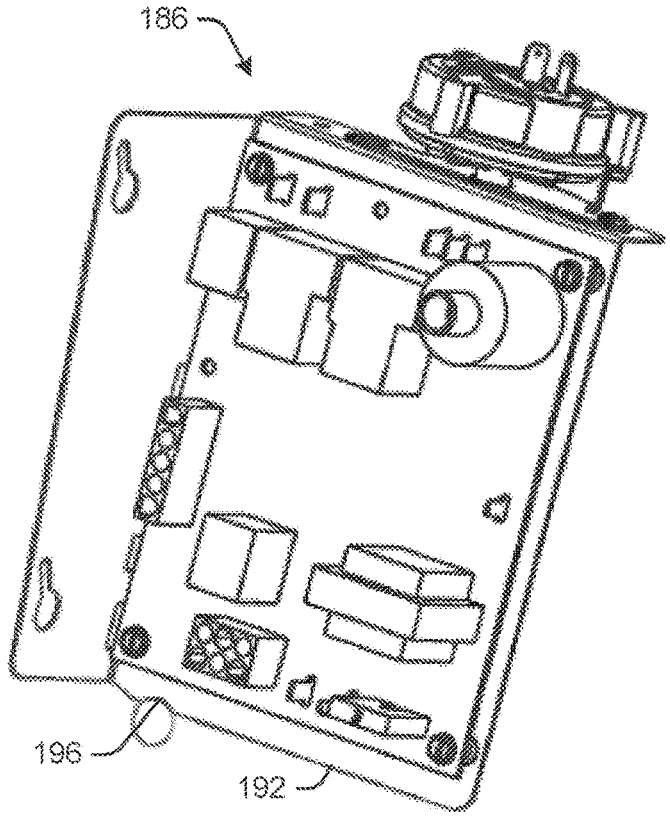
FIG. 19 schematically depicts an example control panel in accordance with one or more embodiments of the disclosure.
Figure 20:
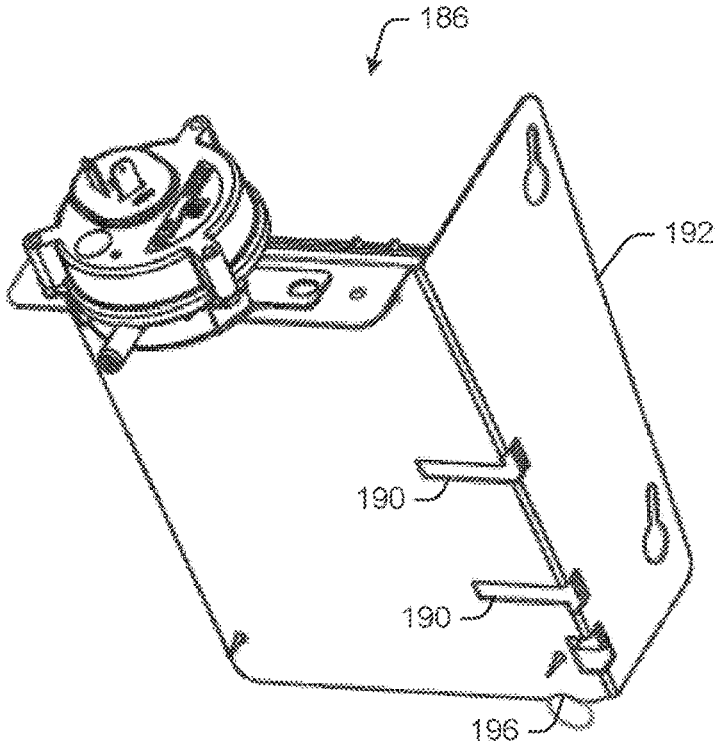
FIG. 20 schematically depicts an example control panel in accordance with one or more embodiments of the disclosure.
Figure 21:
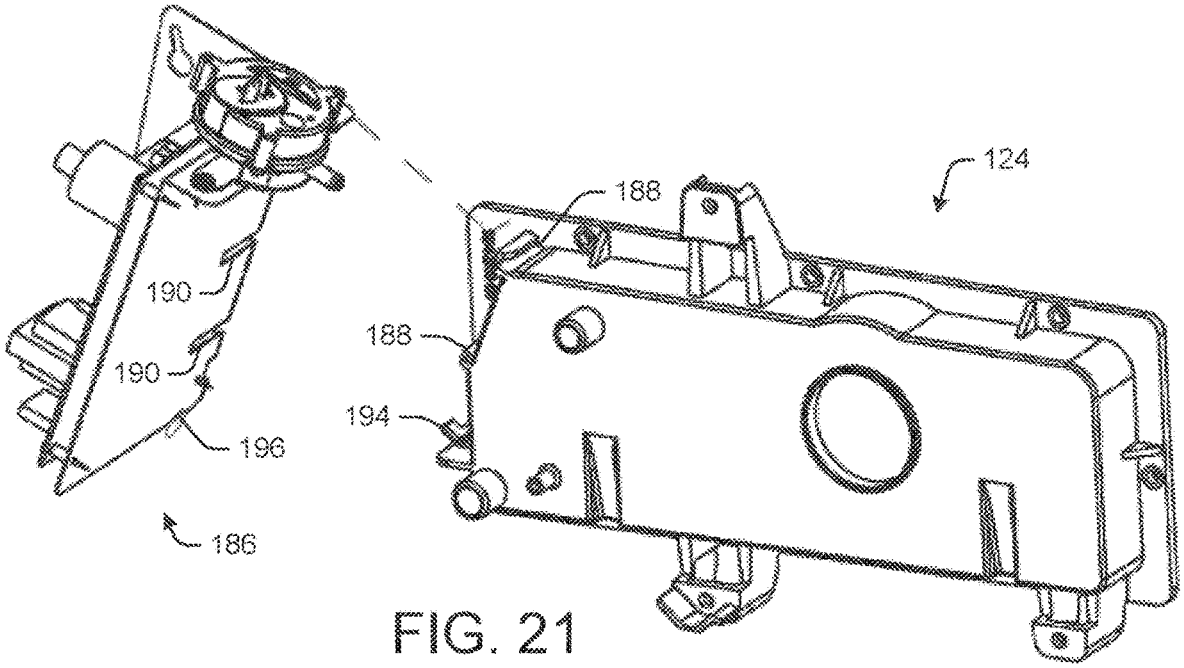
FIG. 21 schematically depicts an example control panel attachment system in accordance with One Or more embodiments of the disclosure.
Figure 22:
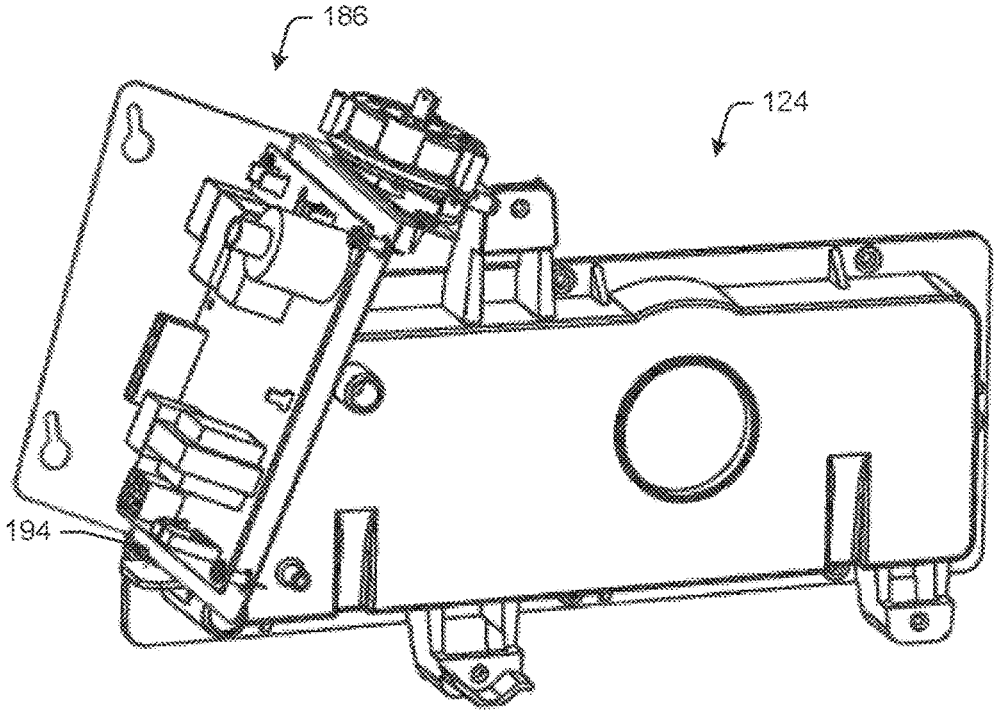
FIG. 22 schematically depicts an example control panel attachment system in accordance with one or more embodiments of the disclosure.

Due to space constraints, and in order to fit the various components within the size of the existing combustion compartment 116, the burner box 118 may be mounted to a substantially vertical vestibule panel 160 within the combustion compartment 116 in a sideways orientation. For example, as depicted in FIGS. 10-12, a first mounting bracket 162 may be attachable to the vestibule panel 160. The first mounting bracket 162 also may be attachable to an inner wall 163 on a first side 164 of the burner box 118. Likewise, a second mounting bracket 166 may be attachable to the vestibule panel 160. The second mounting bracket 166 may be attachable to an outer wall 167 on a second side 168 of the burner box 118. The first mounting bracket 162 may be spaced apart from the second mounting bracket 166 such that the burner box 118 is slidable between the first mounting bracket 162 and the second mounting bracket 166. In this manner, the burner box 118 may be inserted next to the first and second mounting brackets 162, 166 and slid into engagement with the first mounting bracket 162 and the second mounting bracket 166.

As depicted in FIGS. 13-16, the first and second mounting brackets 162, 166 may include an alignment and support protrusion 170 configured to mate with a corresponding alignment hole 172 in the vestibule panel 160. In addition, in order to secure the first and second mounting brackets 162, 166 to the vestibule panel 160 and the burner box 118, the first and second mounting brackets 162, 166 may include a vestibule attachment hole 174 and a burner box attachment hole 176. Any number of alignment and support protrusions 170, vestibule attachment holes 174, and/or burner box attachment holes 176 may be used. A fastener, such as a screw, a bolt, or the like may be inserted into the vestibule attachment hole 174 and a corresponding attachment hole 178 in the vestibule panel 160 for securing the first and second mounting brackets 162, 166 to the vestibule panel 160. Likewise, a fastener, such as a screw, bolt, or the like may be inserted into the burner box attachment hole 176 and a corresponding attachment hole 180 in the burner box 118 for securing the first and second mounting brackets 162, 166 to the burner box 118. In some instances, the second mounting bracket 166 may not include a fastener for attaching the burner box 118. In addition, the first and second mounting brackets 162, 166 may include a burner box alignment protrusion 182 configured to mate with a corresponding alignment hole 184 in the burner box. Any number of burner box alignment protrusions 182 may be used. Other components and other configurations may be used herein.

Referring back to FIGS. 2 and 3, a control panel 186 may be disposed within the combustion compartment 116. Also due to space constraints, and in order to fit the various components within the combustion compartment 116, the control panel 186 may be removably attached to the collector box 124. For example, as depicted in FIGS. 17-22, the collector box 124 may include a channel 188, and the control panel 186 may include a corresponding slot 190. Any number of channels 188 and slots 190 may be used. The slot 190 may be configured to slidably mate with the channel 188. In some instances, the control panel 186 may include an L-shaped base 192 with the slot 190 formed therein.

A tab 194 may be disposed on the collector box 124 adjacent to the channel 188. The tab 194 may be configured to removably secure the slot 190 within the channel 188. For example, the tab 194 may be elastic such that it may slide forward when the slot 190 is slid into the channel 188. The tab 194 may rest in a notch 196 adjacent to the slot 190 to prevent the slot 190 from sliding out of the channel 188. To remove the control panel 186, the tab 194 may be pressed out of the notch 196 to allow the slot 190 to slide out of the channel 188. In this manner, the control panel 186 may no longer be attached to the removable front panel 114 as is typically done. The disclosed configuration enables the control panel 186 to be readily removed from the combustion compartment 116 to access the other components, such as the burner box 118 and/or the inducer blow 120. Other components and other configurations may be used herein.

Referring back to FIG. 2, the exterior casing 106 about the combustion compartment 116 may include an air inlet 198 (louvers) in communication with the outside ambient environment. For example, the combustion compartment 116 may be generally on a non-conditioned space side of the heating and cooling unit 100. That is, the combustion compartment 116 may be generally in communication with the outside ambient environment and substantially sealed off from the interior space.

As noted above, the heating system 102 may include a condensing heat exchanger. A drainage system for the condensing heat exchanger may be disposed within the combustion compartment 116, which may be on the non-conditioned space side of the heating and cooling unit 100 because it is exposed to the outside ambient environment. Typically, drainage from a condensing heat exchanger is routed to the outside environment, with, for example, the drainage line being buried underground. Here, however, the drainage line may be routed through the combustion compartment 116 and into the interior space via the drain adapter 138.

Figure 23:
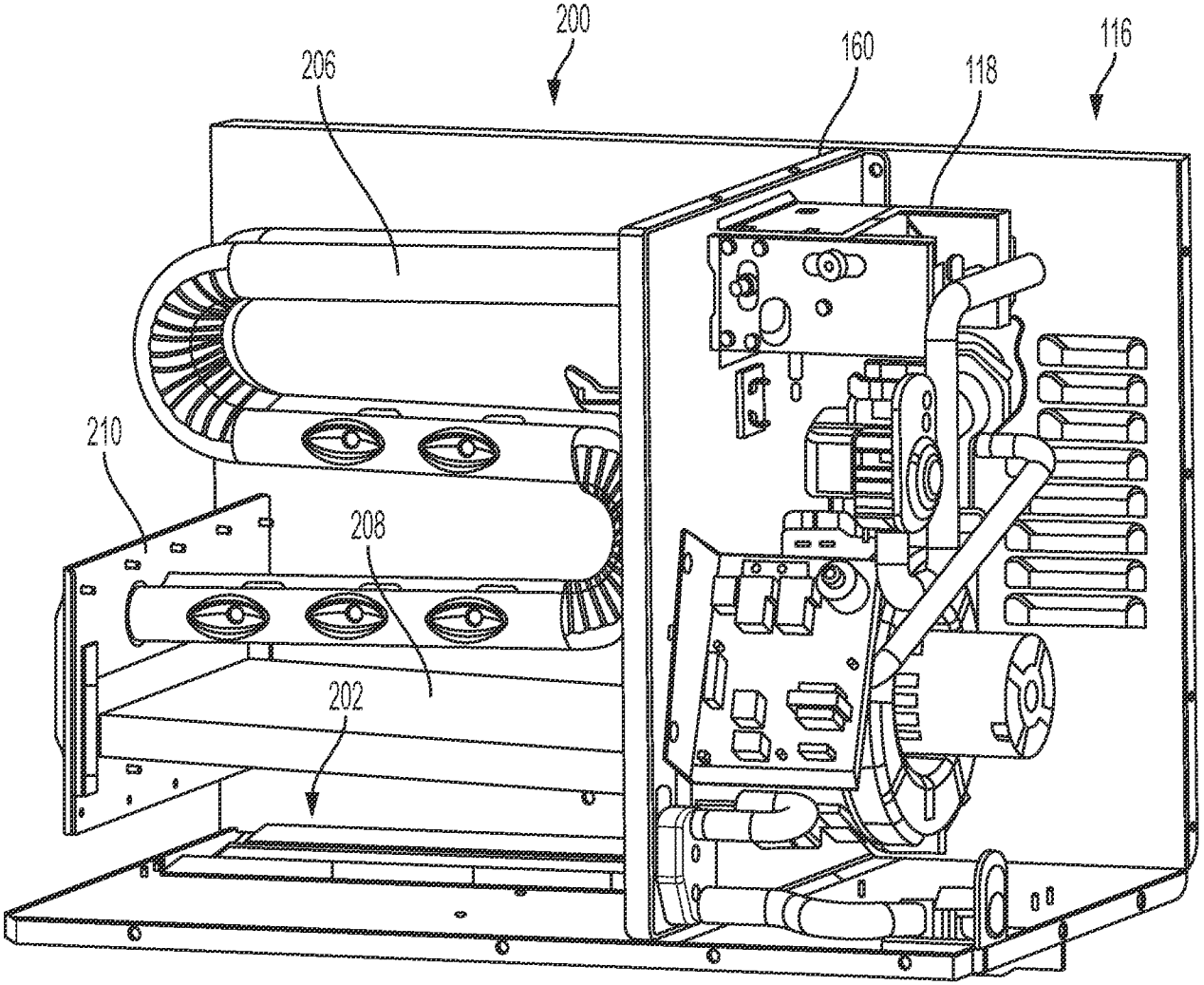
FIG. 23 schematically depicts an example heating system in accordance with one or more embodiments of the disclosure.
Figure 24:
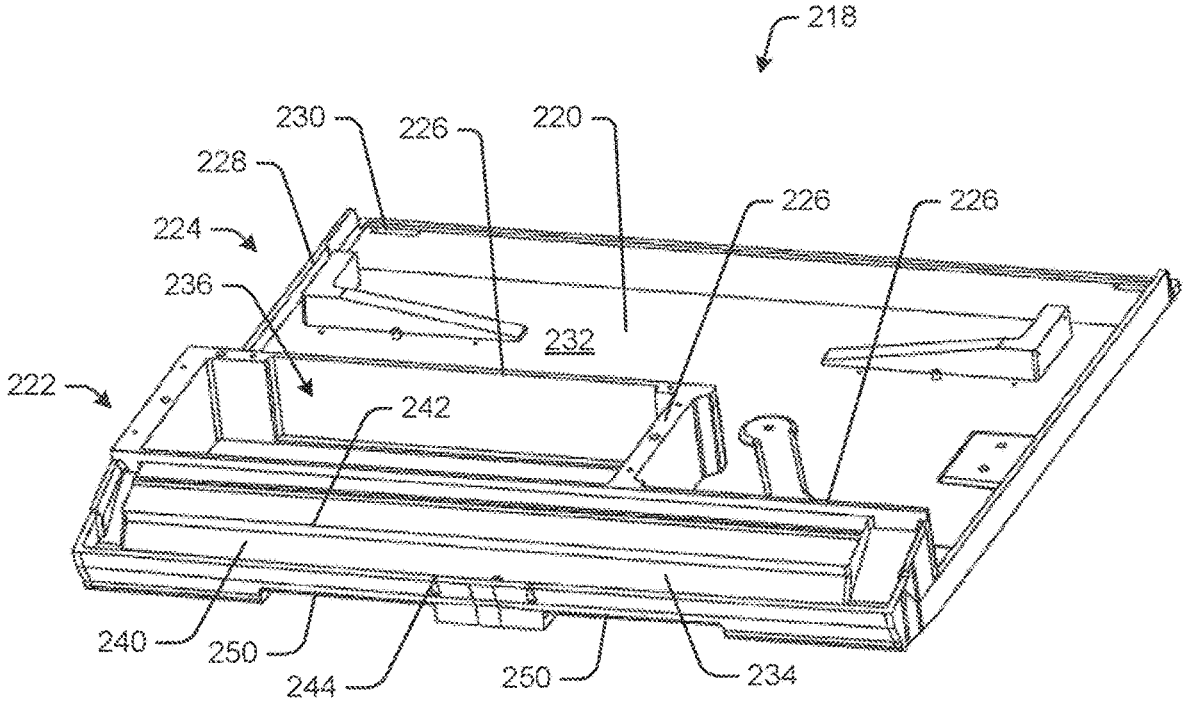
FIG. 24 schematically depicts an example base member in accordance with one or more embodiments of the disclosure.
Figure 25:
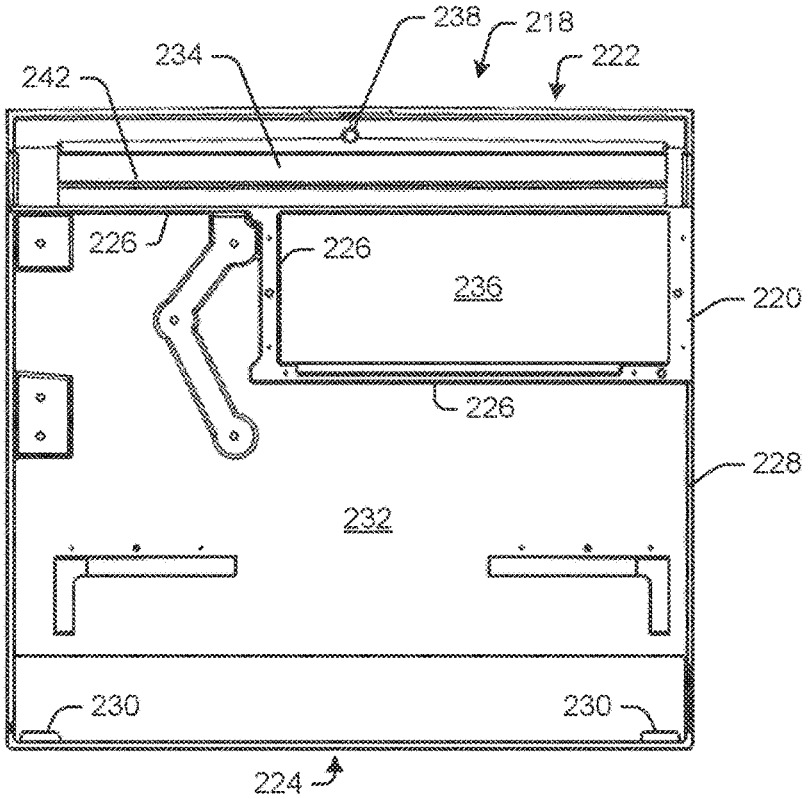
FIG. 25 schematically depicts a top view of an example base member in accordance with one or more embodiments of the disclosure.
Figure 26:
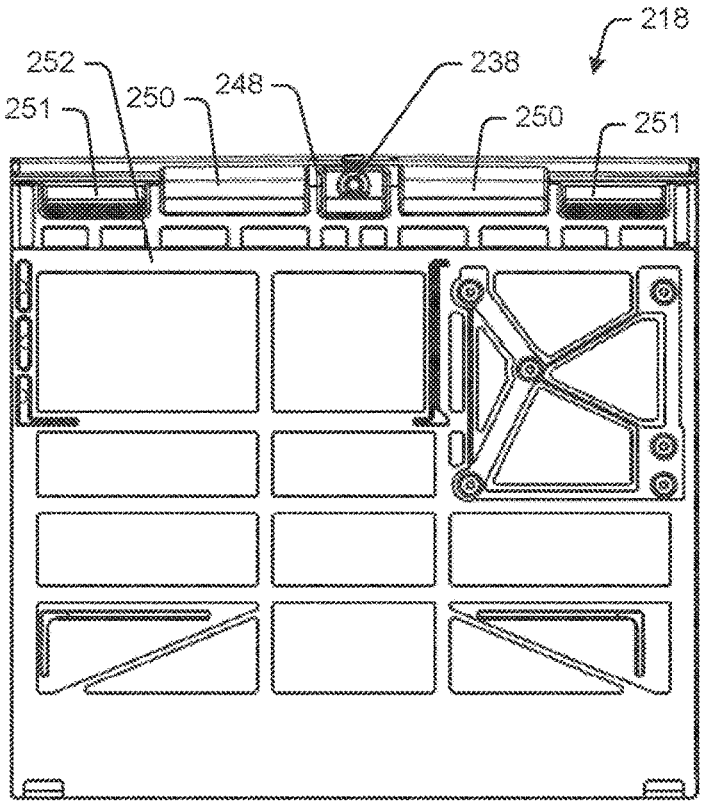
FIG. 26 schematically depicts a bottom view of an example base member in accordance with one or more embodiments of the disclosure.

FIG. 23 depicts a heat exchanger assembly 200, which may be disposed adjacent to the combustion compartment 116. The heat exchanger assembly 200 and the combustion compartment 116 may be separated by the vestibule panel 160. The heat exchanger assembly 200 may include, among other things, an air inlet 202, an air outlet 204 (depicted in FIG. 2), a primary heat exchanger 206, a secondary heat exchanger 208, and a transition box 210 between the primary heat exchanger 206 and the secondary heat exchanger 208. The primary heat exchanger 206 may be in communication with the burner box 118 by way of one or more openings in the vestibule panel 160.

The heat exchanger assembly 200 may be generally on a conditioned space side of the heating and cooling unit 100. That is, the heat exchanger assembly 200 may be generally in communication with the interior space and substantially sealed off from the outside environment. For example, the air inlet 202 may receive air from the interior space, and the air outlet 204 my provide heat air to the interior space. Other components and other configurations may be used herein.

Referring back to FIG. 2, the cooling system 104 may be generally disposed within the cooling system compartment 112 located beneath the division panel 108. The cooling system compartment 112 may include, among other things, a separator panel 212 that separates a conditioned space side from a non-conditioned space of the cooling system compartment 112. An evaporator 214 may be located on the conditioned space side of separator panel 212, and a compressor 216 and condenser 215 may be located on a non-conditioned space side of the separator panel.

Figure 27:
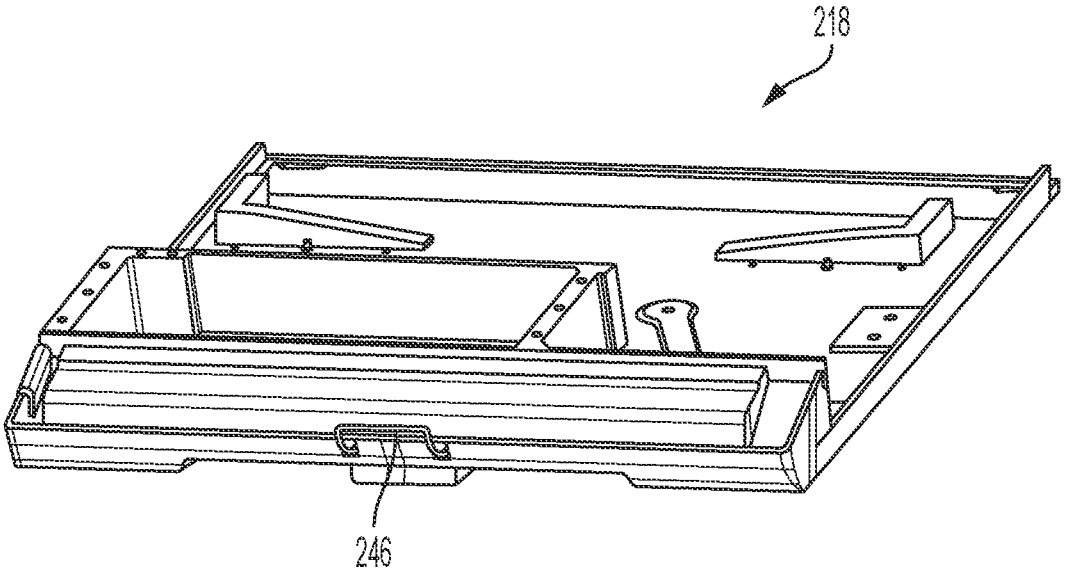
FIG. 27 schematically depicts an example base member in accordance with one or more embodiments of the disclosure.
Figure 28:
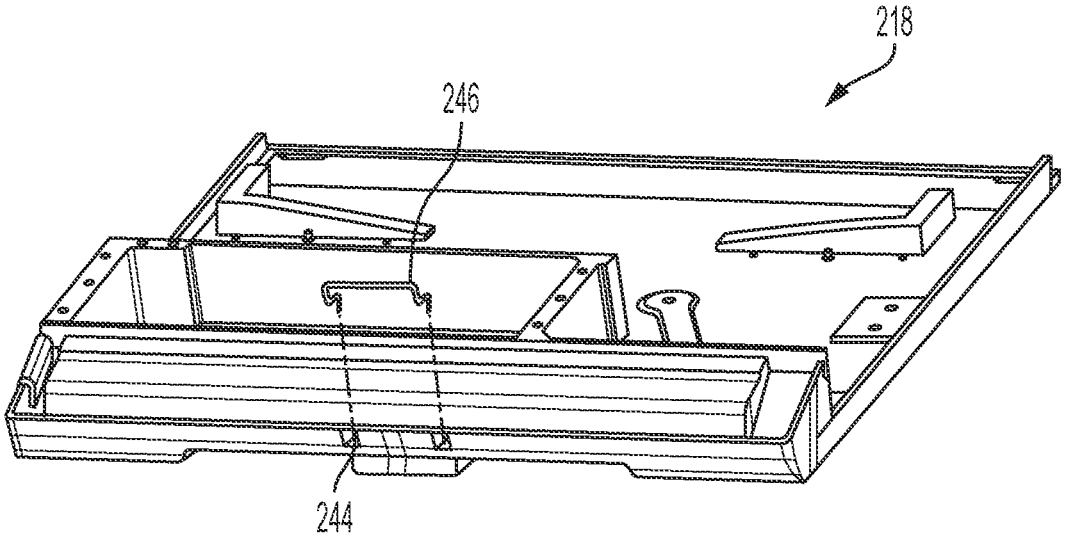
FIG. 28 schematically depicts an example base member in accordance with one or more embodiments of the disclosure.
Figure 29:
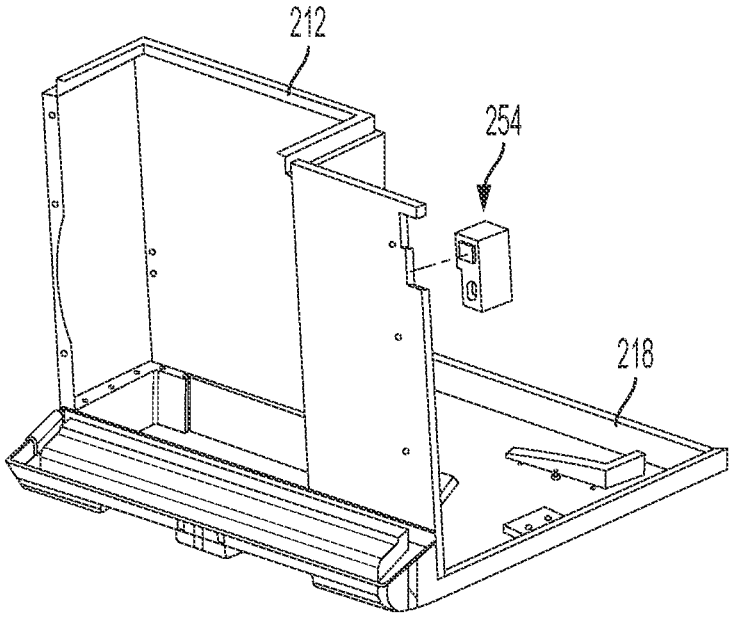
FIG. 29 schematically depicts an example tube chase in accordance with one or more embodiments of the disclosure.
Figure 30:
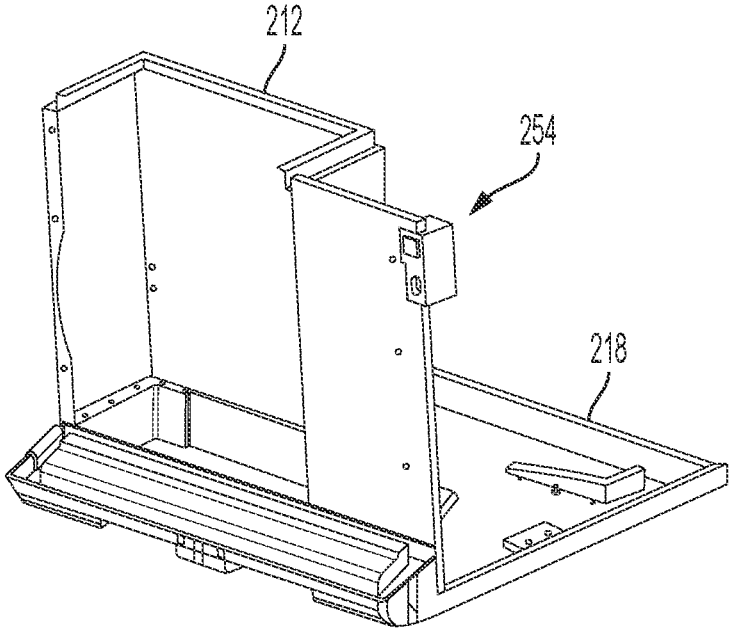
FIG. 30 schematically depicts an example tube chase in accordance with one or more embodiments of the disclosure.

A base member 218 may be disposed about a bottom of the cooling system compartment 112. The base member 218 may be slid in and out of the cooling system compartment 112. As depicted in FIGS. 24-28, the base member 218 may include a substantially horizontal main body 220 configured to support one or more components of the cooling system 104 thereon, such as the evaporator 214 and/or the compressor 216, among others. The main body 220 may include a conditioned space portion 222 about a front of the main body 220 and a non-conditioned space 224 portion about a rear of the main body 220. A substantially vertical separation wall 226 may extend up from the main body 220. In some instances, as depicted in FIGS. 29 and 30, the separator panel 212 may be disposed on top of the separation wall 226. In this manner, the separation wall 226 and the separator panel 212 may separate the conditioned space portion 222 from the non-conditioned space portion 224.

The base member 218 may include a lip 228 formed at least partially about the non-conditioned space portion 224. In some instances, the lip 228 may extend along the sides of the non-conditioned space portion 224 and/or along a perimeter of the non-conditioned space portion 224. A drainage hole 230 may extend through the non-conditioned space portion 224. The drainage hole 230 may be in communication with the outside ambient environment. In some instances, the drainage hole 230 may include two drainage holes 230 disposed at the back corners of the non-conditioned space portion 224. Any number of drainage holes 230 may be used. To facilitate drainage, a surface 232 of the non-conditioned space portion 224 may sloped towards the drainage hole 230.

The conditioned space portion 222 of the base member 218 may include a drain pan 234. The drain pan 234 may receive condensate from the evaporator 214. In some instances, the separation wall 226 and the drain pan 234 may at least partially form an evaporator compartment 236 therebetween. A drainage tube 238 may be in fluid communication with the drain pan 234. In this manner, a surface 240 of the drain pan 234 may be sloped towards the drainage tube 238. In some instances, a substantially vertical sealing rib 242 may be disposed within the drain pan 234. The sealing rib 242 may be configured to make contact with and deform one or more fins on a coil of the evaporator 214 to create a seal between the coil and the sealing rib 242 to force liquid forward into the drain pan 234 towards the drainage tube 238 and to prevent airflow therebetween. As depicted in FIGS. 27 and 28, the drain pan 234 also may include one or more integrated holes 244 disposed for mounting a filter catch 246.

The drainage tube 238 may be disposed beneath the drain pan 234. To ensure that the drainage tube 238 does not break off during installation or maintenance, a protective box 248 may be disposed about the drainage tube 238. In addition, to slide the base member 218 in and out of the cooling system compartment, a molded handled 250 may be formed about the conditioned space portion 222. For example, the molded handle may 250 be disposed beneath the drain pan 234. In some instances, two handles 250 may be molded beneath the drain pan 234. In some instances, one or more additional handles 251 may be positioned adjacent to the handles 250. The additional handles 251 may be used transport the base member 218 after it has been removed.

In certain embodiments, the base member 218 may include a ridge 252 disposed on a bottom of the main body 220 opposite the separation wall 226. The ridge 252 may form a seal under the main body 220 between the conditioned space portion 222 and the non-condition spaced portion 224. For example, the ridge 252 may abut an interior wall (or ridge) of the exterior casing 106 to form a seal therebetween. In some instances, the base member 218 may be a single integrated member. That is, the base member 218 (and its various components) may be molded as a single piece of plastic or the like. Other components and other configurations may be used herein.

As depicted in FIGS. 29 and 30, a tube chase 254 may be attached to the separator panel 212 in order to pass tubing, wiring, and/or other components between the conditioned space portion 222 and the non-condition spaced portion 224 of the cooling system compartment 112. For example, the tube chase 254 may provide a sealed passage through the separator panel 212 for a suction line, a liquid line, and one or more wires of the cooling system 104.

Figure 31:
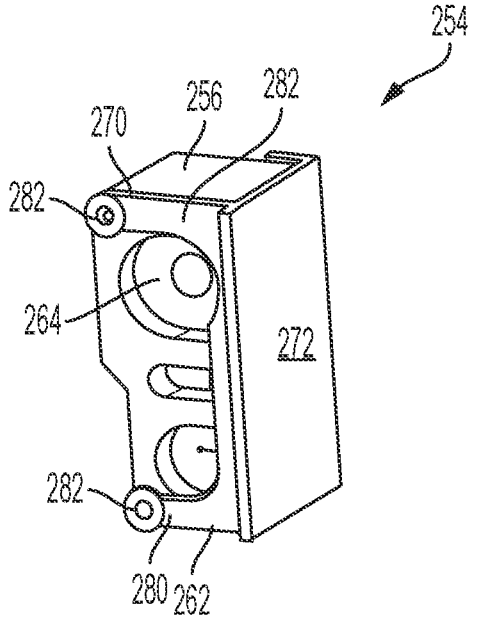
FIG. 31 schematically depicts an example tube chase in accordance with one or more embodiments of the disclosure.
Figure 32:
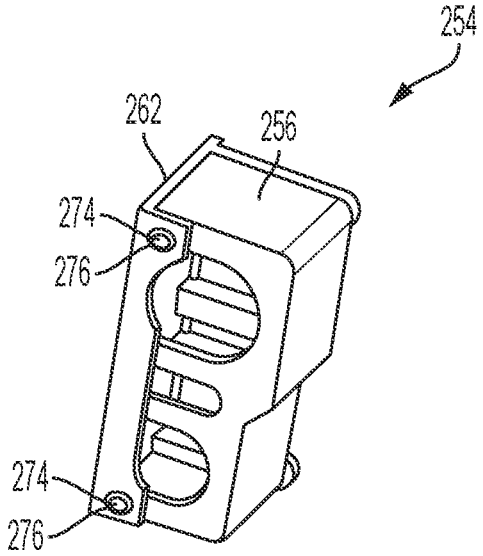
FIG. 32 schematically depicts an example tube chase in accordance with one or more embodiments of the disclosure.
Figure 33:
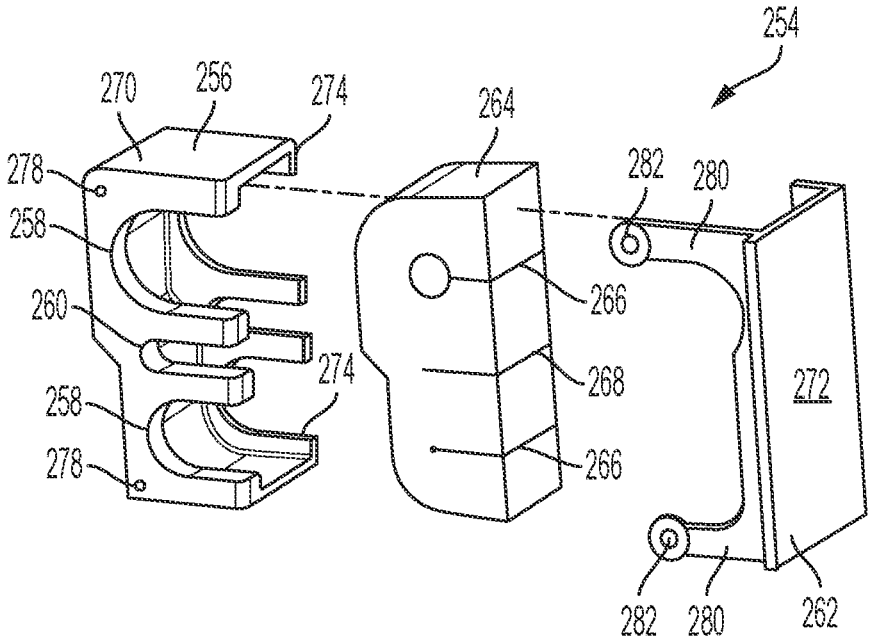
FIG. 33 schematically depicts an example tube chase in accordance with one or more embodiments of the disclosure.

As depicted in FIGS. 31-33, the tube chase 254 may include a tube chase main body 256. The tube chase main body 256 may include a tube slot 258 and/or a wire slot 260. Any number of tube slots 258 and wire slots 260 may be used. The tube chase 254 also may include a removable tube chase cover 262 configured to mate with the tube chase main body 256. A grommet 264 may be positioned within the tube chase main body 256. The grommet 264 may include a tube passage 266 and/or a wire passage 268. Any number of tube passages 266 and wire passages 268 may be used. The tube passage 266 may be aligned with the tube slot 258, and the wire passage 260 may be aligned with the wire slot 268 when the grommet 264 is disposed within the tube chase main body 256.

The tube chase main body 256 may include an attachment groove 270 for attaching the tube chase main body 256 to separator panel 212. The attachment groove 270 may extend at least partially about a perimeter of the tube chase main body 256. In some instances, the tube chase cover 262 may include an exterior surface 272 configured to form a seal with the side panel of the heating and cooling unit 100.

To attach the tube chase main body 256 to the removable tube chase cover 262, the tube chase main body 256 may include an attachment protrusion 274. Likewise, the removable tube chase cover 262 may include an attachment hole 276 configured to mate with the attachment protrusion 274. In addition, the tube chase main body 256 may include an attachment bore 278 configured to receive a fastener therein, and the removable tube chase cover 262 may include an arm 280 having an attachment hole 282 therethrough. The attachment hole 282 may be configured to receive a fastener therein when the attachment bore 278 is aligned with the attachment hole 282. In this manner, the removable tube case cover 262 may be rotatably attached to the tube case main body 256 by positioning the attachment hole 276 within the attachment protrusion 274 and rotating the tube chase cover 262 about the tube chase main body 256 so that the attachment hole 282 is aligned with the attachment bore 278. Other components and other configurations may be used herein.

Figure 34:
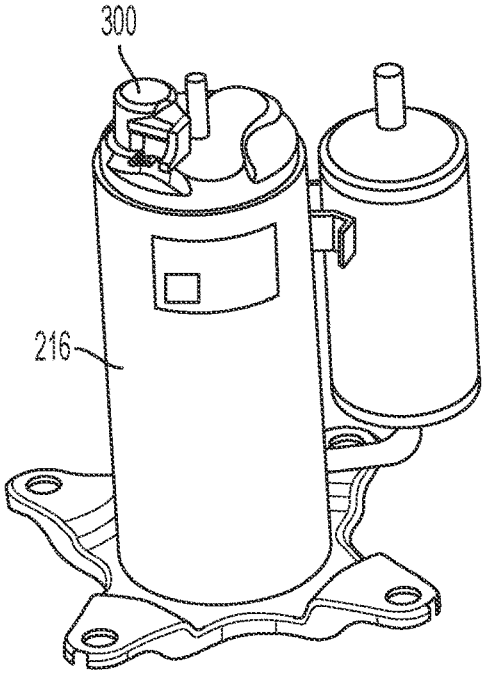
FIG. 34 schematically depicts an example compressor power supply plug in accordance with one or more embodiments of the disclosure.
Figure 35:
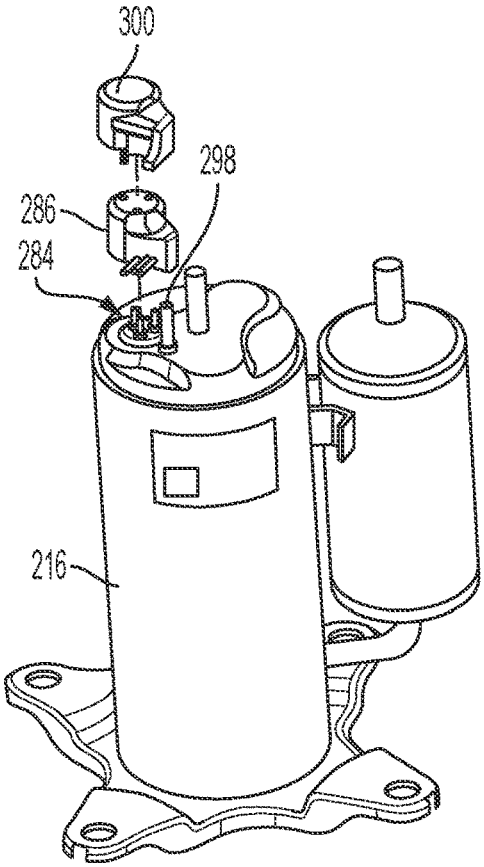
FIG. 35 schematically depicts an example compressor power supply plug in accordance with one or more embodiments of the disclosure.

As noted above, the cooling system 104 may include a compressor 216. As depicted in FIGS. 34 and 35, the compressor 216 may include an electric feedthrough 284. The electric feedthrough 284 may provide a passage for one or more electrical components between the compressor can (e.g., high pressure side of the compressor 216) and the ambient environment. Because the electric feedthrough 284 is positioned between the high pressure side of the compressor 216 and the ambient, it may be prone to blow offs. In order to prevent the electric feedthrough 284 from becoming a projectile, a compressor power supply plug 286 may be attached to the electric feedthrough 284. The compressor supply plug 286 may also form an electrical connection with the electric feedthrough 284.

Figure 36:
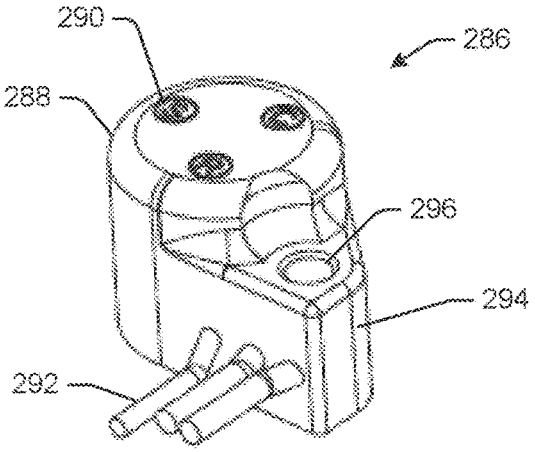
FIG. 36 schematically depicts an example compressor power supply plug in accordance with one or more embodiments of the disclosure.
Figure 37:
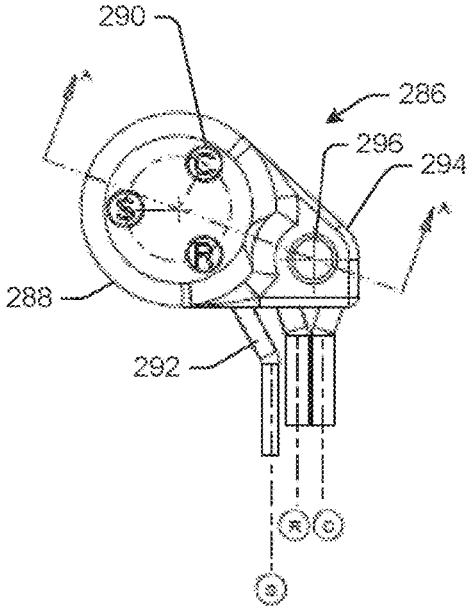
FIG. 37 schematically depicts a top view of an example compressor power supply plug in accordance with one or more embodiments of the disclosure.
Figure 38:
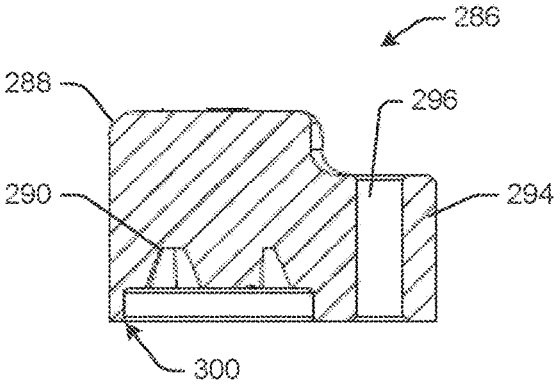
FIG. 38 schematically depicts a cross-section of an example compressor power supply plug in accordance with one or more embodiments of the disclosure.

As depicted in FIGS. 36-38, the compressor supply plug 286 may include a main body 288 attachable to the electric feedthrough 284. The main body 288 may generally form a plug having one or more electrical terminal connections 290 therein for connecting one or more wires 292 to the electric feedthrough 284. For example, in some instances, the electric feedthrough 284 may include one or more male terminals, and the main body 288 may include one or more corresponding female terminals, or vice versa. The compressor supply plug 286 also may include a flange 294 extending from the main body 288. In some instances, the main body 288 and flange 294 may be single molded piece.

The flange 294 may include an aperture 296 extending therethrough. The compressor 216 may include a corresponding stud 298 positioned adjacent to the electric feedthrough 284. The stud 298 may be securely attached to the compressor can. To secure the main body 288 to the electric feedthrough 284, the stud 298 may be positioned within the aperture 296. That is, the aperture 296 may be configured to receive the stud 298 for securing the main body 288 to the compressor 216. In this manner, a fastener (such as a nut or other attachment device) may be threaded onto the stud 298 to capture the main body 288 against the electric feedthrough 284 by way of the flange 294. In addition, the aperture 296 and stud 298 may collectively act as a key to ensure that the main body 288 is properly aligned with the electric feedthrough 284. In some instances, a cap 300 may be positioned over the compressor supply plug 286. In other instances, the cap 300 may be omitted.

The main body 288 and/or the flange 294 may include a sealing surface 300 that mates to a top surface of the compressor can 216 and the electrical feedthrough 284. The sealing surface 300 may prevent moisture from entering the compressor supply plug 286, thereby preventing corrosion from forming between the female terminal 290 and male terminals protruding from electrical feedthrough 284.

The compressor supply plug 286 may be used with a compressor in a heating and cooling unit as described herein, or the compressor supply plug 286 may be used with compressors in other application. The compressor supply plug 286 may be used with any compressor. Other components and other configurations may be used herein.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

The invention claimed is:

1. A heating and cooling unit, comprising:

a heating system comprising a condensing heat exchanger;

a cooling system comprising a refrigeration cycle air conditioner;

an exterior casing comprising a division panel, wherein the division panel is disposed within the exterior casing and is configured to separate the heating system from the cooling system;

a drainage system in fluid communication with the condensing heat exchanger, the drainage system comprising a collector box, a trap, and a convertible drain;

wherein the drainage system is at least partially disposed within a non-conditioned space portion and routed to an interior space of a room that is external to the heating and cooling unit; and wherein the convertible drain comprises:

a drain adapter comprising a first end having an inlet and a second end having an outlet, the inlet being angled relative to the outlet;

a hose, wherein the hose is attachable to the inlet, wherein the drain adapter comprises an attachment bracket and a key hole disposed in a division panel of the heating and cooling unit, wherein the attachment bracket is configured to mate with the key hole in a first configuration with the outlet facing a side of the heating and cooling unit and a second configuration with the outlet facing a front of the heating and cooling unit.

2. The heating and cooling unit of claim 1, wherein the hose is flexible.

3. The heating and cooling unit of claim 1, wherein the hose comprises a fixed bend along a length of the hose.

4. The heating and cooling unit of claim 1, wherein the drain adapter comprises:

a bottom platform comprising an attachment hole therethrough; and a flange extending from the bottom platform and disposed about the outlet, wherein the flange is configured to form a seal about an opening in a side panel of the heating and cooling unit when in the first configuration or form a seal about an opening in a removable front panel of the heating and cooling unit when in the second configuration.

5. The heating and cooling unit of claim 4, wherein the drain adapter comprises:

a front surface extending out from the flange to from a lip therebetween and configured to mate with the opening in the side panel of the heating and cooling unit when in the first configuration or mate with the opening in the removable front panel of the heating and cooling unit when in the second configuration.

6. A heating and cooling unit, comprising:

a conditioned space portion;

a non-conditioned space portion;

a condensing heat exchanger disposed at least partially within the non-conditioned space portion;

a drainage system in fluid communication with the condensing heat exchanger, the drainage system comprising a collector box, a trap, and a convertible drain;

wherein the drainage system is at least partially disposed within the non-conditioned space portion and routed to an interior space of a room that is external to the heating and cooling unit; and wherein the convertible drain comprises:

a hose, the hose comprising a fixed bend along a length of the hose, a drain adapter comprising a first end having an inlet and a second end having an outlet, wherein the hose is attachable to the inlet, wherein the drain adapter comprises an attachment bracket and a key hole disposed in a division panel of the heating and cooling unit, wherein the attachment bracket is configured to mate with the key hole in a first configuration with the outlet facing a side of the heating and cooling unit and a second configuration with the outlet facing a front of the heating and cooling unit.

7. The heating and cooling unit of claim 6, wherein the hose is flexible.

8. The heating and cooling unit of claim 6, wherein the drain adapter comprises:

a bottom platform comprising an attachment hole therethrough; and a flange extending from the bottom platform and disposed about the outlet, wherein the flange is configured to form a seal about an opening in a side panel of the heating and cooling unit when in the first configuration or form a seal about an opening in a removable front panel of the heating and cooling unit when in the second configuration.

9. The heating and cooling unit of claim 8, wherein the drain adapter comprises:

a front surface extending out from the flange to from a lip therebetween and configured to mate with the opening in the side panel of the heating and cooling unit when in the first configuration or mate with the opening in the removable front panel of the heating and cooling unit when in the second configuration.

10. The heating and cooling unit of claim 9, wherein the inlet is angled relative to the outlet.

11. A heating and cooling unit, comprising:

a conditioned space portion;

a non-conditioned space portion;

a condensing heat exchanger disposed at least partially within the non-conditioned space portion;

a drainage system in fluid communication with the condensing heat exchanger;

wherein the drainage system comprises at least one of a collector box, a trap, and a convertible drain; and wherein the convertible drain comprises:

a flexible hose including a fixed bend along a length of the hose;

a drain adapter comprising a first end having an inlet and a second end having an outlet, wherein the hose is attachable to the inlet, wherein the drain adapter comprises an attachment bracket; and a key hole disposed in a division panel of the heating and cooling unit, wherein the attachment bracket is configured to mate with the key hole in a first configuration with the outlet facing a side of the heating and cooling unit and a second configuration with the outlet facing a front of the heating and cooling unit.

12. The heating and cooling unit of claim 11, wherein the drain adapter comprises:

a bottom platform comprising an attachment hole therethrough; and a flange extending from the bottom platform and disposed about the outlet, wherein the flange is configured to form a seal about an opening in a side panel of the heating and cooling unit when in the first configuration or form a seal about an opening in a removable front panel of the heating and cooling unit when in the second configuration.

13. The heating and cooling unit of claim 12, wherein the drain adapter comprises:

a front surface extending out from the flange to from a lip therebetween and configured to mate with the opening in the side panel of the heating and cooling unit when in the first configuration or mate with the opening in the removable front panel of the heating and cooling unit when in the second configuration.

* * * * *